US005450699A

United States Patent [19]

Lee

[11] Patent Number: 5,450,699

[45] Date of Patent: Sep. 19, 1995

[54] FLEXIBLE PARTITIONING MEMBER FOR USE IN FORMING CONCRETE SLAB

[76] Inventor: Nam-Seung Lee, 110 Seogye-dong, Yongsan-ku, Seoul, Rep. of Korea

[21] Appl. No.: 173,140

[22] Filed: Dec. 23, 1993

[51] Int. Cl.[6] ..... E01C 11/04

[52] U.S. Cl. ..... 52/396.02; 404/48; 404/69

[58] Field of Search ..... 52/315, 318, 396.02, 52/396.03, 98, 99, 100; 404/48, 67, 68, 69

[56] References Cited

U.S. PATENT DOCUMENTS

| | | | |
|---|---|---|---|
| 3,782,846 | 1/1974 | Johnson | 404/48 |
| 3,896,597 | 7/1975 | Deason | 52/396.02 |
| 4,346,542 | 8/1982 | Tateno | 52/396.0 X |
| 4,906,129 | 3/1990 | Stegmeier | 404/69 |
| 4,944,124 | 7/1990 | Armstrong | 52/100 X |

FOREIGN PATENT DOCUMENTS

| | | | |
|---|---|---|---|
| 1175745 | 12/1969 | United Kingdom | 404/48 |
| 1509782 | 5/1978 | United Kingdom | 404/48 |

*Primary Examiner*—Carl D. Friedman
*Assistant Examiner*—Creighton Smith
*Attorney, Agent, or Firm*—Ezra Sutton

[57] ABSTRACT

A flexible partitioning member for concrete slab is disclosed, and this partitioning member divides the area (where the concrete slab is to be formed) into a plurality of small areas. The conventional partitioning members are made of wooden material, and can be used only for a horizontal concrete slab. The partitioning member according to the present invention is made by extruding a synthetic resin. The partitioning member includes a main body and a cap, and the cap is detached after the curing of the concrete slab. Into the space which is formed by detaching the cap, a sealing material is filled, so that rainwater cannot intrude into the concrete slab. Further, an inclined cutting line is provided, so that an extra portion can be detached, and that the partitioning member in this case can be used in an inclined concrete slab. In this case, the rainwater is better drained.

1 Claim, 4 Drawing Sheets

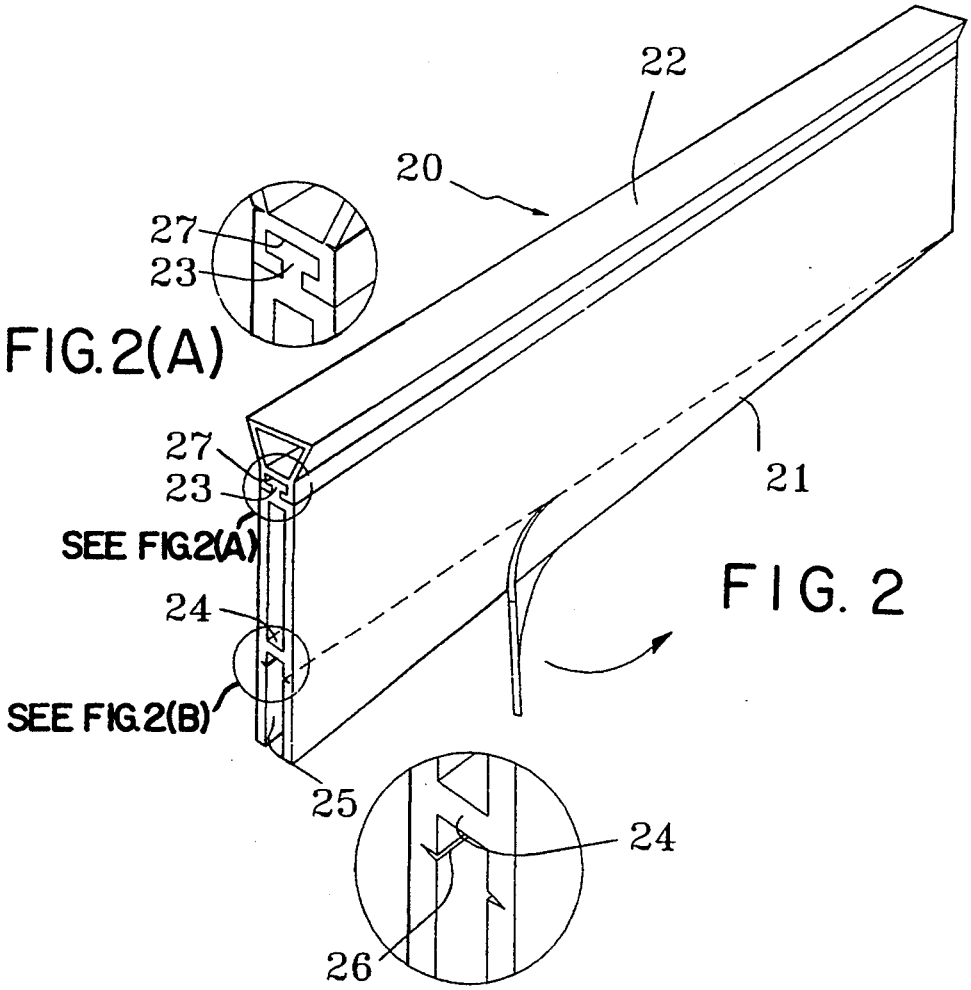
FIG.2(A)
FIG. 2
FIG. 2(B)
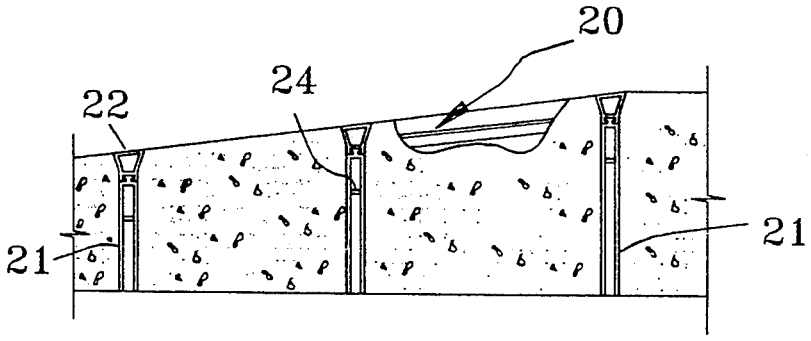
FIG. 3

FLEXIBLE PARTITIONING MEMBER FOR USE IN FORMING CONCRETE SLAB

FIELD OF THE INVENTION

The present invention relates to a flexible partitioning member which is used for preventing the formation of cracks in concrete slab such as concrete roofs, parking lots, runways, taxiways, aprons of air ports, the base of subway, the platform of railway station and the like. In particular, the present invention relates to a flexible partitioning member in which cutting lines are provided, so that the partitioning member can be installed inclinedly, as well as horizontally, when the slabs are formed inclinedly or horizontally.

BACKGROUND OF THE INVENTION

Generally, when concrete structures such as the platform of a railway station, the base of subway and the pavements of roads, parking lots, runways, taxiways, and aprons of airports are built, a mixture of cement, sands, pebbles and water is charged. During the process of curing of the concrete, the water content within the concrete is evaporated to form tiny cavities within the concrete. The concrete having such cavities is subjected to expansions and contractions by the atmospheric heat, and this phenomenon is repeated to finally produce cracks in the concrete slab.

When cracks are formed in the concrete, water intrudes into the cracks to produce various adverse effects. Considering the fact that the formation of the cracks is more frequent proportionately to the total surface area of the concrete formed, the method of reducing the surface area of concrete is devised.

The method of reducing the total surface area of the concrete is such that the total surface area is divided into partitions by using elongate wooden bars.

When the total area is partitioned in this way, the small areas thus partitioned produced only small amount of cracks to such extent that the concrete structure is not substantially affected, thereby achieving the intended purpose.

However, the wooden bars (to be called partitioning member below) which are used for partitioning the total area of the concrete surface can be produced in a uniform thickness and in a uniform height. Therefore they could be used only in horizontal concrete slabs.

That is, referring to FIGS. 1A and 1B, the ceiling of a structure includes: a concrete layer 10 forming a ceiling; a polyethylene foam layer 11 installed upon the concrete layer 10 for heat-insulating and for preventing the intrusion of water; another concrete layer 12 formed upon the polyethylene foam layer 11; a waterproof layer 13 composed of tar and for preventing the intrusion of water; another polyethylene foam layer 14 installed upon the waterproof layer 13; and the final slab 15 formed upon the layer 14.

In the above described slab 15, a flexible partitioning member 16 is installed for preventing cracks. This flexible partitioning member 16 has a uniform thickness and a uniform height as described above, and therefore, it is disposed horizontally upon the upper polyethylene foam layer 14. Therefore it has to be installed horizontally. Thus, if the slab 15 is formed horizontally, water does not flow down but is stagnated.

Therefore, the slab 15 which is the uppermost layer of the structure is formed in an inclined form as shown in FIG. 1B. However, the flexible partitioning member 16 has a uniform height, and therefore, the flexible partitioning member 16 is also inclined as much as the inclination angle. The lower side of this inclined flexible partitioning member is separated from the upper face of the polyethylene foam 14. Therefore, the concrete which is injected into the respective partitions is connected through the separated gaps of the flexible partitioning member 16, with the result that the total concrete portions are connected together, thereby producing cracks in the slab 15.

In the above described ceiling structure, the upper polyethylene foam 14 can be omitted in accordance with the design specification, and the slab 15 is directly formed upon the waterproof layer 13.

The conventional flexible partitioning member 16 as described above has a uniform height. Therefore, in the case where the slab is formed in an inclined form, the lower side of the flexible partitioning member leaves a gap, so that the concrete which is injected into the respective partitions is connected together, thereby producing cracks.

Further, in the case of the conventional flexible partitioning member 16, the edge of the leading end of the flexible partitioning member 16 and the edge of the leading end of the slab 15 are disposed on the same line. In this state, when the concrete slab within a partition is contracted, the portion of the concrete slab which is contacted with the flexible partitioning member 16, i.e., the portion A, forms a slit through which rainwater intrudes. Such intruded water is stagnated below the flexible partitioning member 16, and the water is freezed in winter seasons to expand its bulk. Due to the expansion of the bulk of the freezed water, cracks are produced in the concrete.

SUMMARY OF THE INVENTION

The present invention is intended to overcome the above described disadvantages of the conventional techniques.

Therefore it is the object of the present invention to provide a flexible partitioning member for concrete slabs, in which the flexible partitioning member for partitioning the total area of the concrete slab into narrower portions is provided with cutting lines so as to form the concrete slab horizontally or inclinedly, so that the total area of a concrete slab can be partitioned into perfect sub-areas, thereby preventing cracks.

BRIEF DESCRIPTION OF THE DRAWINGS

The above object and other advantages of the present invention will become more apparent by describing in detail the preferred embodiment of the present invention with reference to the attached drawing in which:

FIG. 2 is a perspective view of the flexible partitioning member according to the present invention;

FIG. 2A is a partial perspective view of a section of FIG. 2 showing in detail the guide rail;

FIG. 2B is a partial perspective view of a section of FIG. 2 showing in detail the reinforcing part;

FIG. 3 is a side sectional view showing the installed state of the device according to the present invention;

DESCRIPTION OF THE PREFERRED EMBODIMENT

Figure 1:
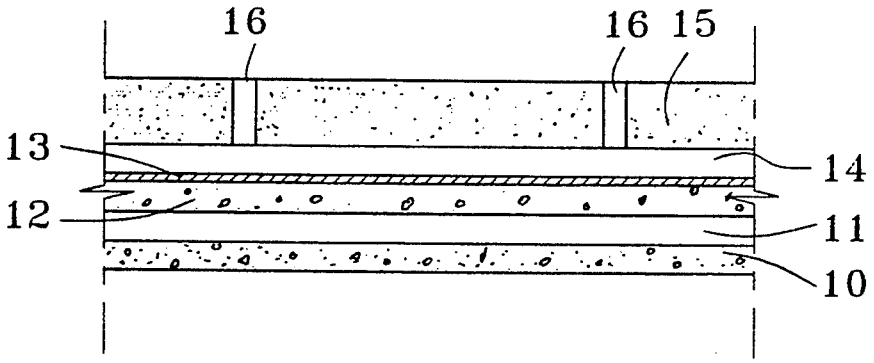
FIGS. 1A and 1B are sectional views showing the conventional device.
Figure 1B:
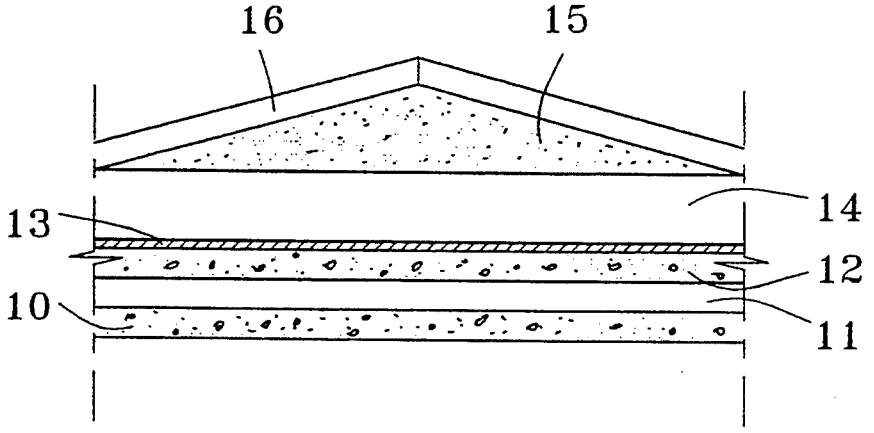

As shown in FIGS. 2 and 3A to 3D, A flexible partitioning member 20 according to the present invention is manufactured by extruding a synthetic resin. This flexible partitioning member 20 consists of: a main body 21 for serving as a separating wall; and a cap 22 installed on the top of the main body for being detached and for forming a space to be filled with a sealing material after the curing of concrete.

The main body 21 is provided with a guide rail 23 on the whole length of the top portion thereof for fitting the cap 22. A reinforcing part 24 is formed along an intermediate portion of the main body 21 for reinforcing the strength of the main body. A cutting line 26 is formed by being pressed and within an extra portion 25 of the lower end of the main body 21, so that the extra portion 25 can be cut off, when forming an inclined concrete slab.

The cutting line 26 is provided with a certain slope, so that the extra portion 25 of the main body 21 can be cut in an inclined form. The value of the slope can be 1/200, 1/100, 1/80,or 1/50, but should be desirably 1/100. 1/80, or 1/50, but should be desirably 1/100.

The cap 22 which is mounted on the top of the main body 21 has a contour with a wide top and a narrow bottom. The cap 22 is provided with a pair of insertion grooves 27 so as to be fitted with the guide rail 23 of the main body 21.

Figure 6:
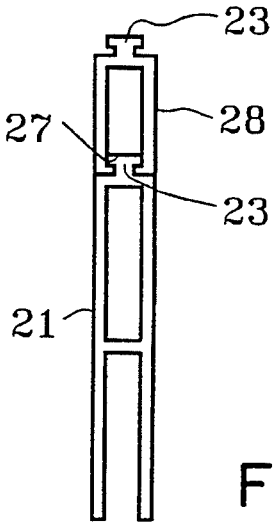
FIG. 6 is a side view of an auxiliary partitioning member installed to the flexible partitioning member according to the present invention.

FIG. 6 illustrates an auxiliary partitioning member 28 installed on the top of the flexible partitioning member 20 for increasing the height of the latter, in the case where the latter is too short. This auxiliary partitioning member 28 is provided with a guide rail 23 for being fit to the insertion grooves 27 of the cap 22. Further, the auxiliary partitioning member 28 is provided with a pair of insertion grooves 27 for being fit to the guide rail 23 of the main body 21.

Now the process of forming a concrete by using the partitioning member of the present invention will be described below.

Figure 5A:
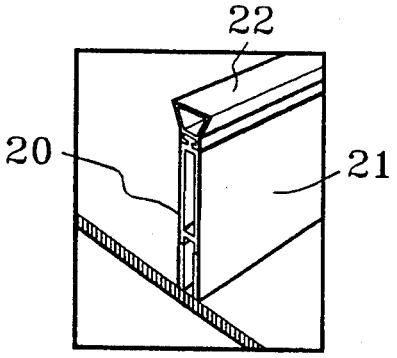
FIGS. 5A to 5D illustrates the use of the device according to the present invention.
Figure 5B:
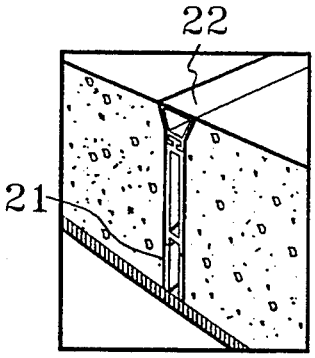
Figure 5C:
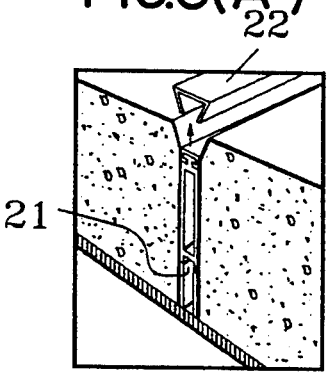
Figure 5D:
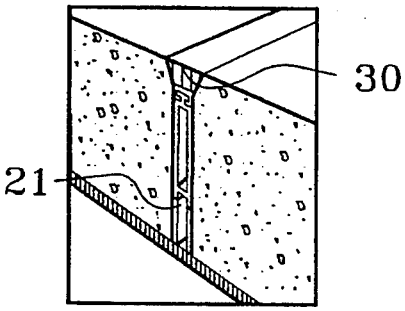

First, in the case where a horizontal slab is formed, as shown in FIGS. 5A to 5D, the flexible partitioning members 20 of the present invention are installed in such a manner that they should form a plurality of partitions. Under this condition, the extra portion of the flexible partitioning member 20 is not cut off, and therefore, the tops of the flexible partitioning members form a horizontal plane. In this state, concrete paste is injected into the respective partitions, and after the curing of the concrete, the cap 22 is detached from the main body 21 by means of a tool such as a screw driver as shown in FIG. 5C, so that there should remain a V shaped space as shown in FIG. 5D. If a sealing material is filled into these V shaped spaces, then the formation of a flat concrete is completed.

Figure 4:
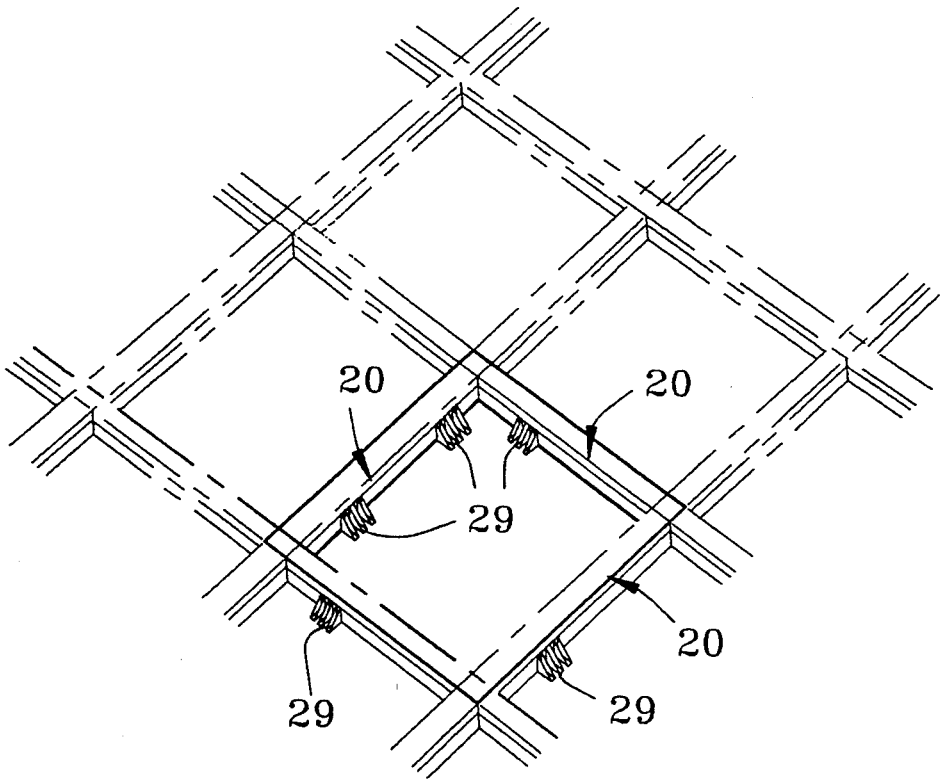
FIG. 4 is a perspective view showing the installed state of the device according to the present invention.

Second, in the case where an inclined concrete slab is to be formed (which is the virtual subject matter of the present invention), the pair of the extra portions 25 are pulled out as shown in FIG. 2, so that the pair of the extra portions 25 should be detached along the cutting lines 26 in an inclined form. Thus the flexible partitioning members 20 which are cut off in an inclined form are made stood on the floor by using securing pieces 29 as shown in FIGS. 3 and 4, thereby dividing the total surface into a plurality of partitions.

If the flexible partitioning members 20 which are cut in an inclined form are made stood on the floor where the concrete is to be formed, the tops of the flexible partitioning members 20 form an inclined plane. In this state, concrete paste is injected into the respective partitions, so that the top of the concrete should form an inclined plane.

After the curing of the concrete, the caps 22 are removed in the same manner as that of the horizontal concrete, so that V shaped spaces should remain where the caps 22 are detached. Then the sealing material 30 is filled into the V shaped spaces, and thus, the expansion and contraction of the concrete cannot affect the concrete, while the intrusion of the rainwater through the V shaped spaces can be prevented.

As the slab is formed in an inclined form, the rainwater flows down naturally. Meanwhile, the auxiliary partitioning member 28 which is illustrated in FIG. 6 is used on the high portions, in the case where the concrete is formed in an inclined form. That is, if the auxiliary partitioning member 28 is fitted onto the top of the main body 21, the height of the partitioning member is increased as much as the auxiliary partitioning member 28.

According to the present invention as described above, the flexible partitioning member is provided with a cutting line, so that the extra portion can be detached in an inclined form, thereby making it possible to form the concrete horizontally or inclinedly.

If an inclined concrete slab is formed by using the flexible partitioning member with the extra portion detached, the rainwater flows down in a natural manner, so that the rainwater should not be able to intrude into the slab.

Further, a sealing material is filled into the V shaped spaces which are formed by detaching the caps of the partitioning members, thereby completely blocking the intrusion of rainwater.

What is claimed is:

1. A flexible partitioning member for use in forming a concrete slab which is formed from concrete that is cured and subject to forming cracks, said partitioning member being used to partition the concrete slab into a plurality of small areas for preventing the formation of crack, the flexible partitioning member comprising:

a main body 21 having a top portion and a guide rail 23 disposed along said top portion, and a pair of inclined cutting lines 26 for detaching a pair of extra portions 25 along said cutting lines 26 in an inclined form; and a V-shaped cap 22 having a pair of insertion grooves for detachably fitting to said guide rail 23 of said main body 21, and for being detached after the curing of the concrete, a sealing material being filled into said V-shaped space formed by detaching said cap 22.

* * * * *